United States Patent [19]

Marshall et al.

[11] 3,943,138

[45] *Mar. 9, 1976

[54] PROCESS FOR UNIFORMLY DRAWING POLYETHYLENE TEREPHTHALATE FILAMENTS TO FORM HIGH SHRINKAGE FIBERS

[75] Inventors: Geoffrey Marshall; Eric Ivan Riseley, both of Harrogate, England

[73] Assignee: Imperial Chemicl Industries, Ltd., London, England

[ * ] Notice: The portion of the term of this patent subsequent to Mar. 30, 1993, has been disclaimed.

[22] Filed: Sept. 11, 1972

[21] Appl. No.: 288,213

[30] Foreign Application Priority Data

Sept. 22, 1971 United Kingdom ..... 44202/71

[52] U.S. Cl. ..... 264/290 T

[51] Int. Cl.[2] ..... B29C 17/02

[58] Field of Search.. 264/290 T, DIG. 73, DIG. 28, 264/290 R, 290 N, 210 F

[56] References Cited

UNITED STATES PATENTS

| | | | |
|---|---|---|---|
| 2,468,081 | 4/1949 | Koster | 264/DIG. 73 |
| 3,077,004 | 2/1963 | Mummery | 264/290 T |
| 3,134,833 | 5/1964 | Ciporin et al. | 264/290 T |
| 3,259,681 | 7/1966 | Bull et al. | 264/210 F |
| 3,444,681 | 5/1969 | Reese | 264/210 F |
| 3,527,862 | 9/1970 | Shimosako | 264/290 T |
| 3,557,273 | 1/1971 | Bergwerk | 264/290 T |

FOREIGN PATENTS OR APPLICATIONS

| | | | |
|---|---|---|---|
| 758,398 | 10/1956 | United Kingdom | 264/290 T |

*Primary Examiner*—Robert F. White
*Assistant Examiner*—James B. Lowe
*Attorney, Agent, or Firm*—Herbert M. Adrian, Jr.

[57] ABSTRACT

A process for uniformly drawing tows of poly(ethylene terephthalate) to produce high shrinkage fibres wherein the drawing is effected with the tow in a hot water saturated condition at a controlled birefringence, temperature and draw ratio. The product has initial shrinkages (as defined) of at least 5% and a high uniformity.

10 Claims, No Drawings

PROCESS FOR UNIFORMLY DRAWING POLYETHYLENE TEREPHTHALATE FILAMENTS TO FORM HIGH SHRINKAGE FIBERS

This invention relates to the drawing of synthetic thermoplastic filaments and in particular to a process for drawing tows of synthetic filaments to produce a drawn product of high shrinkage.

In the manufacture of staple fibres from synthetic thermoplastic polymers in order that reasonably high productivity may be achieved large numbers, usually some hundreds, of filaments are produced by melt extrusion of the molten polymer through a multiorifice spinneret and the groups of filaments from a plurality of spinnerets are combined into a tow which is then subjected to a drawing operation to impart the desired physical properties to the filaments comprising the tow. Because of the combination of many thousands of filaments which have been produced under conditions which may vary somewhat it has hitherto been impossible to produce drawn tows of very high uniformity and accordingly some compromise has had to be accepted either in terms of the uniformity of the physical properties of the drawn filaments, or of the freedom to apply different processing conditions, as for example different draw ratios.

In our copending cognate patent application U.S. Ser. No. 184,842 filed Sept. 29, 1971, we have described a drawing process by means of which very much more uniform drawing of tows may be achieved even when the undrawn tow is highly non-uniform. Uniformity is achieved in this process by saturating the tow while supported on a plurality of feed rolls with hot water and adjusting the conditions so that drawing is completed before the tow leaves the support of the feed rolls and by this means high draw ratios may be applied even to non-uniform undrawn tows. The present process is an improvement in or modification of the aforementioned process wherein a low draw ratio may be applied to produce a highly uniform drawn tow comprising poly(ethylene terephthalate)filaments having a high shrinkage. Application of a draw ratio low enough to produce a product of high shrinkage has the effect of moving the zone within which drawing occurs downstream and at least partly off the feed rolls of a multiroll drawing machine. This movement of the draw zone into a region where the drawing filaments are unsupported produces unstable drawing and results in a less uniformly drawn product. It is the purpose of the present invention to overcome these deficiencies when drawing occurs in an unsupported region as in the production of high shrinkage products.

According to the present invention we provide a process for uniformly drawing a tow of poly(ethylene terephthalate) filaments comprising passing a tow at least partly around the peripheries of a plurality of feed rolls in series and a plurality of draw rolls in series the latter rotating at a higher peripheral speed, characterised in that the tow in contact with at least some of the feed rolls is treated with an aqueous liquid at a temperature of 60° – 80°C, the filaments comprising the undrawn tow have an intrinsic viscosity of 0.3 to 0.75 and a mean birefringence of $2 \times 10^{-3}$ to $9 \times 10^{-3}$ and a draw ratio is applied such as to give drawn filaments having an initial shrinkage as hereinafter defined of at least 5%.

Initial shrinkage is defined as the shrinkage in water at 70°C under a load of 0.011 grams per decitex. The final shrinkage hereinafter referred to is the further shrinkage in air at 180°C under the same load, 0.011g/decitex. Final shrinkage may be positive or negative; that is to say it may be a shrinkage or an extension under the prescribed load at 180°C. Methods for determination of the shrinkages are described hereinafter. Intrinsic viscosity is measured in deciliters per gram at 25°C in solution in o-chlorophenol. Birefringence is measured in the usual way using a polarising microscope or similar device.

Poly(ethylene terephthalate) tows and staple fibres as normally produced have substantially zero initial shrinkage and a positive final shrinkage. Tows and fibres having a high initial shrinkage are required for blending with natural or synthetic fibres having little or no shrinkage to produce mixtures which in yarn or fabric form develop bulk and a highly desirable soft handle when treated so that the shrinkable fibres are caused to shrink. Hitherto such fibres of high initial shrinkage have been produced from special copolymers or by underdrawing poly (ethylene terephthalate) tows by applying very low draw ratios. The latter process is very difficult to operate successfully since drawing is unstable, the draw point not being stationary and inevitably substantial amounts of undrawn or variably drawn filaments are produced greatly reducing the reproducibility of the process and lowering the value and usefulness of the product.

It is a feature of the present invention that uniform drawing may be effected at the low draw ratios required to produce a high shrinkage product.

Bulk may be developed in blends containing shrinkable fibres in two general ways; either by application of the shrinkage treatment, usually heat in some form, to the blend yarn or to a fabric made from or including a blend yarn. For treatment of a yarn to produce shrinkage it is necessary to treat the yarn in a condition such that shrinkage can take place. For example shrinkage of a yarn may be effected during dyeing if the yarn is wound on partially collapsible carriers usually called springs. Shrinkage occurs during dyeing and some bulk is produced in the yarn the amount being dependant upon the restraints present. It is common practice to heat treat a fabric produced from the dyed bulky yarn at fixed dimensions to stabilise it. Such a further treatment may be effected on a stenter in which the fabric is passed under some lateral tension through an air oven. Under these conditions of heat and tension there will be a tendancy for some bulk to be pulled out or not developed especially if the shrinkage forces developed are high at the elevated stentering temperatures which are of the order of 180°C for poly(ethylene terephthalate) fabrics. Accordingly it is desirable that tows and staple fibres for the production of fabrics in the foregoing way should have negative final shrinkage as hereinbefore defined and it is preferred that this final shrinkage should be at least −4%, that is to say an extension of at least 4% should occur in the test for final shrinkage as hereinafter described.

Thus according to a preferred form of this invention we provide a process for uniformly drawing a tow of poly(ethylene terephthalate) filaments having an intrinsic viscosity of 0.3 to 0.75 and a mean birefringence of $2 \times 10^{-3}$ to $9 \times 10^{-3}$ comprising treating the tow in contact with at least some and preferably all of the feed rolls with an aqueous liquid at a temperature of 60° –

80°C and applying to the tow a maximum draw ratio (MDR) according to the equation;

$$MDR = A - B(IV) - C(Bi) - D(T) + E(IV)(Bi)$$

where T is the temperature of the water in °C, IV is the intrinsic viscosity and Bi is the mean birefringence of the undrawn filaments multiplied by $10^3$ and A, B, C, D and E are numerical constants having the values 6.3 ± 0.1, 1.74, 0.281, 0.0244 and 0.310 respectively.

When all the bulk is to be developed in the fabric for example by treatment in steam or in water, rather than in the yarn it is preferred to use tows or staple fibres having a somewhat higher minimum initial shrinkage and in particular an initial shrinkage of at least 9% when treatment is with water at 70°C because of the forces restricting shrinkage in the piece. The final shrinkage in this case should also be negative and at least 4%. To produce a tow having these properties by a process according to this invention a maximum draw ratio according to the following equation should be applied;

$$MDR = A - B(IV) - C(Bi) - D(T) + E(IV)(Bi)$$

where IV, Bi and T have the aforementioned meaning and the numerical constants A, B, C, D and E have the values 4.1 ± 0.1, 0.32, 0.148, 0.0093 and 0.107 respectively.

According to a further feature of the present invention we provide uniform high shrinkage poly(ethylene terephthalate) filaments or staple fibres but therefrom having properties which make them particularly suitable producing bulky yarns and fabrics as hereinbefore described. Such filaments or fibres have an initial shrinkage of at least 5% and a uniformity corresponding to a coefficient of variation of decitex of less than 10% and an undrawn segment count of less than 10 per $10^5$ filaments. For the production of bulk by thermal treatment of a yarn containing filaments of fibres according to this invention it is preferred that the filaments or fibres should have a positive final shrinkage. For the production of bulk by shrinkage treatment of a fabric containing filaments or fibres according to this invention it is preferred that the filaments or fibres should have an initial shrinkage of at least 9% and a negative final shrinkage of at least 4% that is to say an extension of at least 4% in the final shrinkage test at 180°C.

The foregoing drawing conditions allow the production of high shrinkage tows of very high uniformity at high drawing speeds. The most preferred conditions of drawing are an aqueous liquid temperature of 65° ± 2°C and a maximum draw ratio of 3.3:1 for material which is to be shrunk as yarn and 2.9:1 to 3.0:1 for material shrunk in fabric form, the intrinsic viscosity and mean birefringence of the undrawn filaments being 0.485 and $4 \times 10^{-3}$ respectively.

It is preferred to apply a resilient surfaced nip roll to a tow in contact with the first feed roll of the drawing apparatus to prevent any supply tension variations passing through the feed roll system to the draw zone.

It is also preferred that a minimum draw ratio of about 2:1 is used in a process according to this invention since below this value there is an enhanced possibility of non-uniform drawing occurring.

The aqueous liquid at an elevated temperature may be applied in a process according to this invention to all or only some of the feed rolls but if applied to only some of the rolls those to which it is applied should be successive rolls and should include the last roll. The liquid is preferably applied by means of sprays since by this means the necessary complete wetting and saturation of a tow and all the filaments comprising it may be easily obtained. The aqueous liquid may be water alone but a preferred alternative is a dilute aqueous solution or dispersion of a surface active, lubricating by other treating material which on subsequent drying of the tow will leave a residue of the material on the filaments comprising the tow to facilitate subsequent processing of the tow or staple fibres cut therefrom.

In a process according to this invention some improvement in properties of the drawn product in particular an increase in initial shrinkage, may be achieved by inserting a tow cooling means between the feed and draw rolls to cool the drawn filaments below the drawing temperature before they reach the draw rolls. A preferred such cooling means is a stream of cold water applied to the tow beyond the draw zone but as near to it as possible, preferably not more than 30cm beyond it and before the first draw roll.

The following Examples illustrate the invention and the manner in which it may be performed. The measurements of initial and final shrinkage are made in the following way.

A 90 cm length of sub-tow of approximately 1200 – 2000 decitex is cut from the tow and the ends knotted to form a loop. The weight of the loop is determined as a measure of decitex and its length ($L_1$) when loaded with a load of 0.11 grams per decitex is measured. The load is then removed the loop doubled and a load of 0.011 grams per decitex applied before immersing the doubled loop in water at 70°C for 10 minutes after which the load is removed the loop unfolded and the length ($L_2$) measured under the original load of 0.11 grams per decitex. The initial shrinkage is then calculated from the relationship $$\frac{L_1 - L_2}{L_1} \times 100$$

The mean of 5 measurements on different specimens is taken as the initial shrinkage value.

For the measurement of final shrinkage the loop is again doubled replacing the load of 0.11 g/decitex with one of 0.011 g/decitex before the doubled loop is heated in an air oven at 180°C for 10 min when the loop length ($L_3$) is remeasured under the load of 0.11 g/decitex. The final shrinkage (or more usually extension) is then calculated from $$\frac{L_2 - L_3}{L_2} \times 100$$

The presence or absence of undrawn segments in the filaments comprising a drawn tow is measured in the following way. A 30 cm. specimen of tow is prepared by folding on itself or by sub-division to produce a thickness of $10^5$ filaments from which a cross section of fibres 3 mm. long is cut from the middle of the folded tow. The short fibres are then dyed with a suitable dye such as Dispersol fast scarlet B (Colour Index No. 11110) and the dyed fibres are distributed over a filter paper surface by suction. Undrawn segments appearing as darker specks are counted and expressed as the number per $10^5$ filaments in the 3 mm. cross-section. By this means very small amounts of undrawn fibre segments may be detected. In all these Examples a set of seven feed rolls and seven draw rolls is used to carry out the process with a hot aqueous solution of a lubricant/antistatic mixture supplied by a spray to each roll and a resilient nip roll applied to the first feed roll.

For measurement of the coefficient of variation of filament or fibre decitex a cross section of a sample of filaments or fibres containing at least about 100 fibres is made and the diameters of a random selection of 50 of these is measured in 10 sub-groups of 5 fibres each using a suitable microscope or microprojector to produce a magnified image. The range of diameters measured in each group is determined and from this the mean range for the 10 sub-groups. The mean diameter for the 50 cross sections is also calculated and the coefficient of variation of decitex is then calculated from the relation $$\text{Coefficient of variation} = \frac{86 \times \text{mean range}}{\text{mean diameter}}$$

EXAMPLE 1

Sixty-five sub tows each comprising 424 poly(ethylene terephthalate) filaments having a total decitex of 4900, an intrinsic viscosity of 0.485 and a mean birefringence of $4.0 \times 10^{-3}$ are combined into a tow and passed in a sinuous path around part of the periphery of each of the feed rolls. The portions of tow in contact with each roll are thoroughly saturated by continuous sprays of heated water containing 0.1% by weight of a lubricant dispersed therein and maintained by recirculation through heating means at a constant temperature of 70°C. From the last feed roll the tow passes to a set of draw rolls rotating at a peripheral speed of 90 meters per minute which apply a draw ratio of 2.8:1.

The drawn product has the following properties:

| | |
|---|---|
| Initial shrinkage % | 16.7 |
| Final shrinkage % | −11 |
| Tenacity g/decitex | 2.8 |
| Undrawn segments/$10^5$ filaments | 1 |
| Coefficient of variation of decitex % | 5.7 |

EXAMPLE 2

Sixty-five sub-tows each comprising 1000 poly(ethylene terephthalate) filaments having a total decitex of 3825, an intrinsic viscosity of 0.675 and a mean birefringence of $7.0 \times 10^{-3}$ are combined and drawn as in Example 1 using a lubricant dispersion temperature of 65°C, a draw ratio of 2.4:1 and a draw speed of 90 meters per minute.

The drawn product has the following properties;

| | |
|---|---|
| Initial shrinkage % | 33.0 |
| Final shrinkage % | −23.8 |
| Tenacity g/decitex | 3.7 |
| Undrawn segments/$10^5$ filaments | 0 |
| Coefficient of variation of decitex % | 7.2 |

EXAMPLE 3

A tow comprising 65 subtows each having 424 poly(ethylene terephthalate) filaments and a total decitex of 4400, 0.4 intrinsic viscosity and $2.0 \times 10^{-3}$ mean birefringence is drawn as in Example 1 using a lubricant dispersion temperature of 75°C, a draw ratio of 3.2:1 and a draw speed of 90 meters/minute.

The drawn product has the following properties:

| | |
|---|---|
| Initial shrinkage % | 8.2 |
| Final shrinkage % | −5.0 |
| Tenacity g/decitex | 2.2 |
| Undrawn segments/$10^5$ filaments | 0 |
| Coefficient of variation of decitex % | 6.3 |

EXAMPLE 4

A tow comprising 310 sub-tows each having 504 poly(ethylene terephthalate) filaments and a total decitex of 4880, prepared from polymer of 0.485 intrinsic viscosity pigmented grey with a mixture of white and black pigments is drawn using a draw ratio of 2.9:1 and sprays of an aqueous solution containing 3.5% by weight of a textile lubricant at a temperature of 65° ± 2°C and a drawing speed of 90 meters per minute. The sprays keep the tow on the feed rolls and for some distance downstream saturated with heated lubricant solution. Ten tonnes of drawn product are produced without interruption of the drawing process, the drawn product having the following properties;

| | |
|---|---|
| Initial shrinkage % | 12.2 |
| Final shrinkage % | −8.0 |
| Tenacity g/decitex | 2.7 |
| Undrawn segments/$10^5$ filaments | 3 |
| Coefficient of variation of decitex % | 7.1 |

EXAMPLE 5

A tow comprising 65 sub-tows each having 504 poly(ethylene terephthalate) filaments and a total decitex of 4880, an intrinsic viscosity of 0.475 and a mean birefringence of $4.0 \times 10^{-3}$ is drawn as in Example 1 using a spray temperature of 65°C a draw ratio of 2.9:1 and a drawing speed of 90 meters per minute. A quantity of the same tow is also drawn in the same way except that the drawn tow is cooled before it reaches the draw rolls by the application of streams of cold water to the tow downstream of the draw zone over a length of 130 cm.

The comparative properties of the drawn products with and without post draw cooling are:

| | No Cooling | With Cooling |
|---|---|---|
| Initial shrinkage % | 12.2 | 13.3 |
| Final shrinkage % | −7.0 | −6.8 |
| Tenacity g/decitex | 2.8 | 2.85 |
| Undrawn segments/$10^5$ filaments | 2 | 2 |
| Coefficient of variation of decitex % | 6.2 | 6.3 |

What we claim is:

1. A process for uniformly drawing a tow of poly(ethylene-terephthalate) filaments to form high shrinkage fibers comprising passing a tow at least partly around the peripheries of a plurality of feed rolls in series and a plurality of draw rolls in series the latter rotating at a higher peripheral speed, characterised in that the tow in contact with more than one of the feed rolls is sprayed with a saturating amount of aqueous liquid at a temperature of 60° - 80°C., the filaments comprising the undrawn tow have an intrinsic viscosity of 0.3 to 0.75 and a mean birefringence of $2 \times 10^{-3}$ to $9 \times 10^{-3}$ and a draw ratio of 2.0:1 to 3.3:1 is applied such as to give drawn filaments having an initial shrinkage in 70°C. water under a load of 0.011 grams per decitex of at least 5%.

2. A process according to claim 1 wherein the draw ratio applied does not exceed A − B (IV) − C (Bi) − D (T) + E (IV) (Bi) where T is the temperature of the liquid in °C, IV is the intrinsic viscosity and Bi is the mean birefringence of the undrawn filaments multiplied by $10^3$ and A, B, C, D and E are numerical constants having the values 6.3 ± 0.1, 1.74, 0.281, 0.0244 and 0.310 respectively.

3. A process according to claim 1 wherein the draw ratio applied does not exceed A − B (IV) − C (Bi) − D (T) + E (IV) (Bi) where IV is the intrinsic viscosity, Bi is the mean birefringence of the undrawn filaments and T is the temperature of the liquid in °C and the numerical constants A, B, C, D and E have the values 4.1 ± 0.1, 0.32, 0.148, 0.0093 and 0.107 respectively.

4. A process according to claim 1 wherein the aqueous liquid has a temperature in the range 63° – 67°C., the filaments comprising the undrawn tow have an intrinsic viscosity of 0.48 and a mean birefringence of $4 \times 10^{-3}$ and a draw ratio in the range 2.9:1 to 3.3:1 is applied.

5. A process according to claim 1 wherein the draw ratio is not less than 2.0:1.

6. A process according to claim 1 wherein the aqueous liquid is water.

7. A process according to claim 1 wherein the aqueous liquid is a dilute solution or dispersion of a surface active or lubricating material.

8. A process according to claim 1 wherein cooling means is applied to the drawn tow before it reaches the draw rolls.

9. A process according to claim 8 wherein the cooling means is a stream of cold water.

10. The process of claim 1 wherein the aqueous liquid is applied to a plurality of feed rolls by spraying successive rolls including the last feed roll.

* * * * *